United States Patent [19]

Dozzo

[11] Patent Number: 4,715,156

[45] Date of Patent: Dec. 29, 1987

[54] SUPPORT STRUCTURE FOR ROOF INSULATION IN METAL BUILDINGS

[75] Inventor: John J. Dozzo, Rio Rancho, N. Mex.

[73] Assignee: Duke Insulation Company, Inc., Albuquerque, N. Mex.

[21] Appl. No.: 902,602

[22] Filed: Sep. 2, 1986

[51] Int. Cl.[4] ..... E04B 1/74

[52] U.S. Cl. ..... 52/404; 52/664; 52/732

[58] Field of Search ..... 52/404, 732, 733, 664, 52/666

[56] References Cited

U.S. PATENT DOCUMENTS

| | | | |
|---|---|---|---|
| 2,029,679 | 2/1936 | Seving et al. | 52/404 X |
| 3,956,788 | 5/1976 | Nagin | 52/664 X |
| 3,995,403 | 12/1976 | Nickell | 52/732 X |
| 4,251,972 | 2/1981 | Interlante | 52/404 |
| 4,379,381 | 4/1983 | Holcombe | 52/404 |

FOREIGN PATENT DOCUMENTS

| | | | |
|---|---|---|---|
| 3001479 | 7/1980 | Fed. Rep. of Germany . | |
| 3106299 | 9/1982 | Fed. Rep. of Germany | 52/404 |
| 3328868 | 2/1985 | Fed. Rep. of Germany | 52/666 |

*Primary Examiner*—William F. Pate, III
*Assistant Examiner*—Creighton Smith
*Attorney, Agent, or Firm*—H. Gordon Shields

[57] ABSTRACT

Structural members extending between purlins in the roof support for metal buildings include different types of end support elements secured to flanges of the purlins and have a modified "V" cross sectional configuration for structural integrity. Different end configurations are utilized for different types of purlins.

13 Claims, 15 Drawing Figures

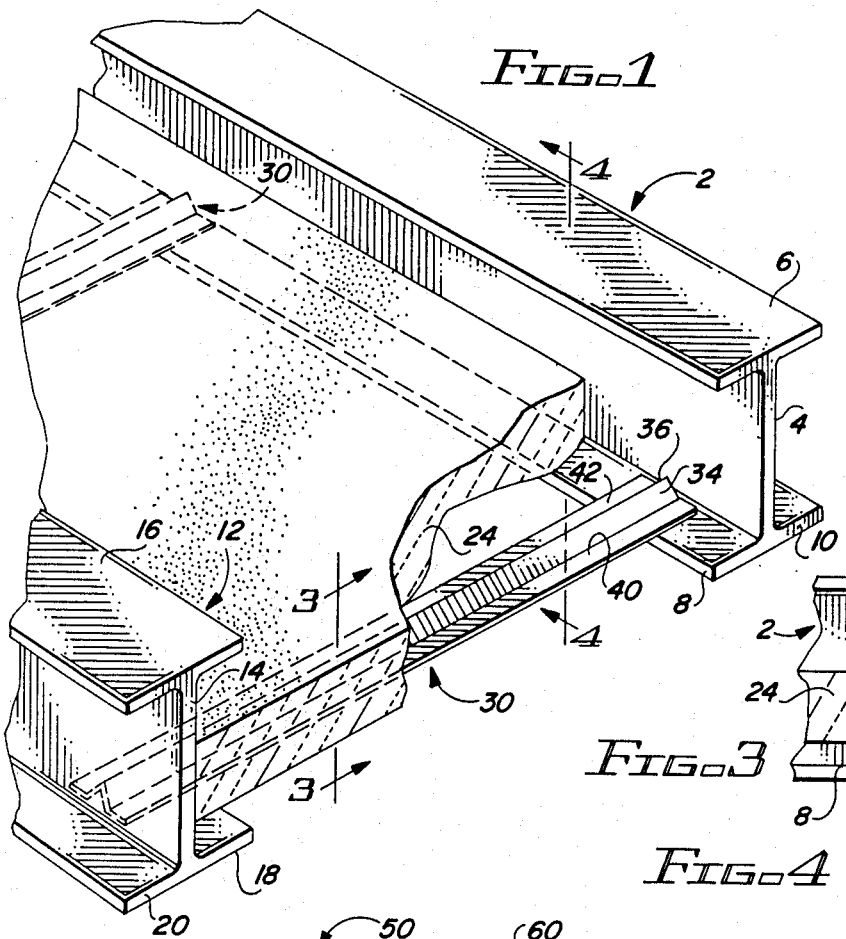
FIG. 1
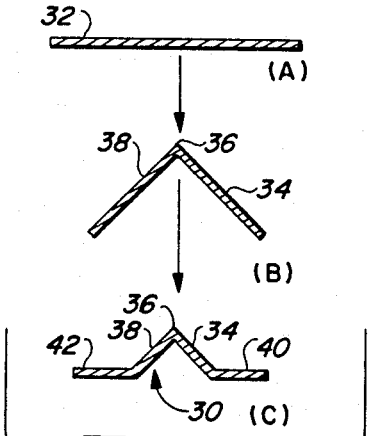
FIG. 2
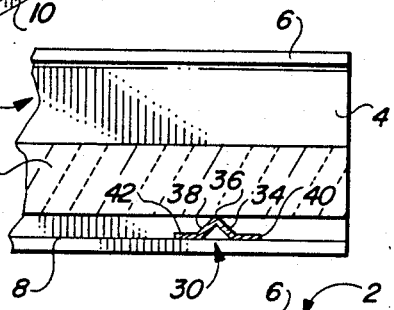
FIG. 3
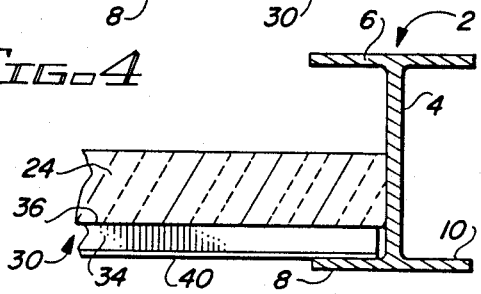
FIG. 4
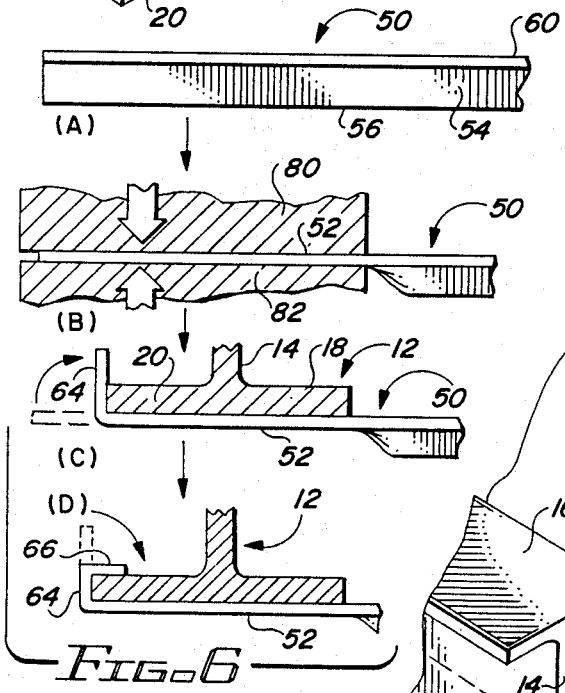
FIG. 6
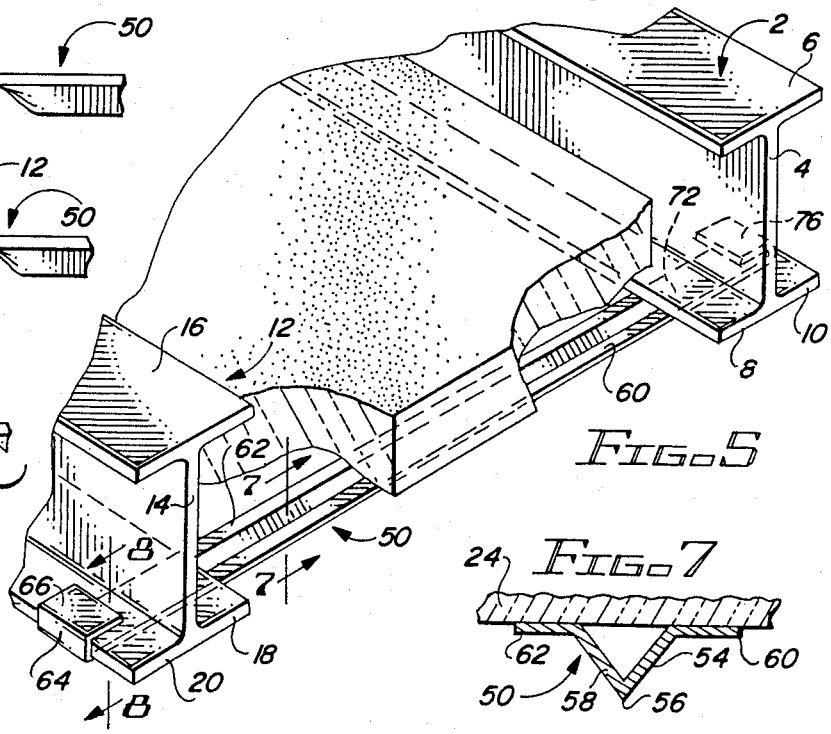
FIG. 5
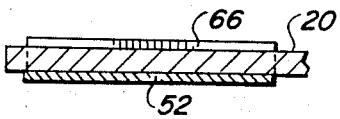
FIG. 8
FIG. 7

SUPPORT STRUCTURE FOR ROOF INSULATION IN METAL BUILDINGS

BACKGROUND OF THE INVENTION

1. Field of the Invention

This invention relates to structures for supporting insulation in metal buildings, and, more particularly, to structural elements extending between purlins for supporting insulation between the purlins in metal building structures.

2. Description of the Prior Art

U.S. Pat. No. 1,574,329 (White) discloses cross bracing for structural members between "C" type purlins. The cross braces extend generally diagonally from the top of one purlin to the bottom of an adjacent purlin. They accordingly define an "X" configuration between purlins. Each cross brace consists essentially of three portions, a central strap portion and two end portions riveted to the central strap. The end portions are configured to be secured to the flanges of the purlins. The end members may be considered as clips to be fastened onto the flanges. The flanges are referred to in the patent as eye-beam structural members with marginal flanges which extend respectively downwardly and upwardly from the outer end of the top and bottom horizontal flanges.

U.S. Pat. No. 4,147,003 (Alderman) discloses a roof structure for a steel building. The structure includes a support grid between purlins and insulation material disposed on the structural grid. The structural grid is not claimed in detail. The apparatus is designed primarily for "Z" shaped purlins. The structural grid, in each case, is secured to the top flange of each purlin.

U.S. Pat. No. 4,251,972 (Interlante) discloses a structural support member usable with "Z" shaped purlins for supporting insulation between the purlins. The structural support member has a center configuration between purlins of a generally flat "U" shape, with the arms extending slightly outwardly from a relatively wide center web portion. One end of the support member is plain, and is disposed on the top of a bottom flange of one purlin. The opposite end of the support member is curved to fit underneath an adjacent purlin and to hook onto the bottom flange of the adjacent purlin.

U.S. Pat. No. 4,263,763 (Bouwens) discloses an insulation support structure for metal buildings, with the structure extending between bottom flanges of "Z" type purlins. The support members extend longitudinally, and a panel extends between the support members. The insulation is in turn disposed on the panel. The support members accordingly are lengthwise with respect to the purlins, with the panels extending corsswise between the purlins.

U.S. Pat. No. 4,266,384 (Orals et al) discloses a ceiling furring system for supporting insulation. Channels to which gypsum board ceiling panels are secured are fastened to ceiling joists by means of furring clips. Insulation is then disposed on top of the gypsum board ceiling panels and the channels. The cross sectinal configuration of the channels is that of a generally wide "U" with the arm of the "U" disposed slightly outwardly. Flanges extend outwardly from the tops of the arms. The flanges are generally parallel to the bottom of the channel.

U.S. Pat. No. 4,303,713 (Clemensen et al) discloses a roof insulation system in which a medium density thermo-insulation blanket extends between "Z" configured purlins, and low density insulation is disposed on top of the medium density insulation. The medium density insulation is generally self supporting between adjacent purlins. The self supporting medium density insulation is disposed or supported on the top elements of adjacent purlins and on top of longitudinally extending metal bands. The bands extend parallel to the purlins, and transversely or laterally extending bands are in turn secured to the longitudinally extending bands. The transverse or lateral bands are disposed on the purlins.

U.S. Pat. No. 4,375,741 (Paliwoda) discloses a method and apparatus for installing insulation in metal buildings, including a grid support extending between purlins. The grid includes diagonally extending members and support members that are secured to the top flanges of the purlins. Insulation is in turn disposed on the grid structure. The apparatus is designed for the "Z" shaped purlins. The cross-sectional configuration of diagonal members is that of a relatively wide "U" with the arms extending outwardly from the bottom element.

U.S. Pat. No. 4,379,381 (Holcombe) discloses another type of insulation system, including a support structure secured to "Z" shaped purlins and insulation disposed on top of the support structure. The support structure includes rigid structural elements extending between and secured to the purlins, and specifically to the top flanges of the purlins. While the cross members are thus secured to the top flanges of the purlins, there are additional rigid structural support members extending between the cross members and disposed substantially parallel to the purlins. On top of this supporting structure are disposed at least two different kinds of insulation elements, including a bottom semi-rigid layer. The lower, or bottom, semi-rigid layer includes a vapor barrier. Several different embodiments of the insulation layers are illustrated.

U.S. Pat. No. 4,384,437 (Coles) discloses another type of insulation support system for metal building utilizing "Z" type purlins. The insulation system includes a heat insulation sleeve secured to the bottom flange or web of each purlin, and a plurality of cross members extending between purlins for supporting insulation. The cross members are in the general configuration of an inverted "T", and are secured by clips to the purlins. Several different embodiments of the blankets for the purlin webs are shown, with different configurations for different types of purlins. Thus, in addition to the common "Z" type purlin, other types of purlins are also illustrated.

U.S. Pat. No. 4,441,294 (Riley) discloses a support grid for supporting roof insulation in a metal building in which purlins of different cross-sectional configurations are illustrated. The supporting grid includes cross members which are secured to the purlins, and longitudinal members which are in turn secured to the cross members and which extend substantially parallel to the purlins. The cross-sectional configuration of the cross members is generally that of a block "U" with outwardly extending flanges from the ends of the parallel arms of the "U" portions. The cross-sectional configuration of the parallel members, secured to the inverted "U" cross members is generally simply an inverted "U" without the flanges.

Different configurations of cross members are illustrated to extend between purlins of different cross-sectional configurations.

BRIEF DESCRIPTION OF THE DRAWING

FIG. 1 is a perspective view of the apparatus of the present invention disposed beneath a pair of purlins and supporting insulation.

FIG. 2 is a sequential view illustrating forming the cross-sectional configuration of the apparatus of the present invention.

FIG. 3 is a view in partial section taken generally along line 3—3 of FIG. 1.

FIG. 4 is a view in partial section taken generally along line 4—4 of FIG. 1.

FIG. 5 is a perspective view illustrating an alternate embodiment of the apparatus of the present invention.

FIG. 6 is a Figure illustrating sequentially the forming of the apparatus of the present invention.

FIG. 7 is a sectional view of the apparatus of FIG. 6 taken generally along lines 7—7 of FIG. 5.

FIG. 8 is a view in partial section taken generally along line 8—8 of FIG. 5.

DESCRIPTION OF THE PREFERRED EMBODIMENT

Figure 9:
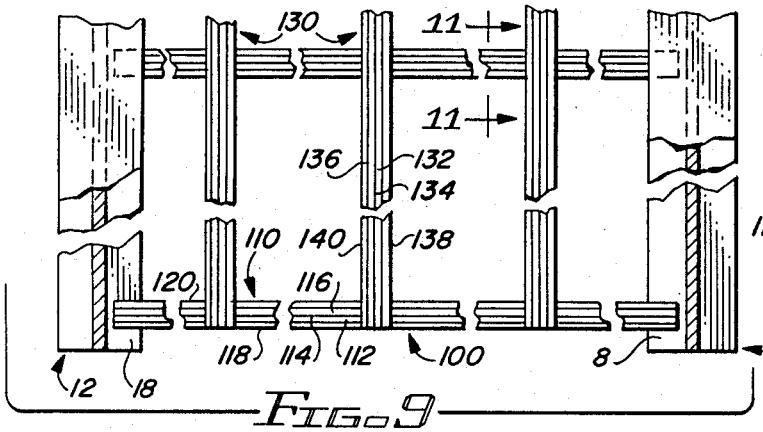
FIG. 9 is a top view illustrating a grid of the apparatus of the present invention.

FIG. 1 is a perspective view of a pair of steel I-beam purlins 2 and 12, spaced apart and generally parallel to each other, with two cross braces 30 extending between the purlins and supporting an insulation batt 24. The insulation batt 24 extends between the purlins 2 and 12 and is disposed on the cross braces 30. One of the cross braces 30 is shown in dotted line disposed beneath the insulation blanket, and part of the insulation blanket or batt 24 has been broken away to show a portion of the other cross brace 30.

FIG. 2, comprising sequential FIGS. 2A, 2B, and 2C, is a sequential view illustrating the forming of a cross brace 30 from a steel strap or ribbon. FIG. 3 is a view in partial section taken generally on line 3—3 of FIG. 1. FIG. 4 is a view in partial section taken generally along line 4—4 of FIG. 1. Both FIGS. 3 and 4 illustrate the employment of a cross brace 30 with respect to the purlin 2 and the insulation 24. For the following discussion, reference will generally be made to FIGS. 1, 2, 3, and 4.

The purlin 2 is an I-beam type purlin which includes a vertical web 4 and a pair of flanges. At the top of the web 4 is a horizontally extending flange 6. At the bottom of the web 4 there is also a horizontally extending flange. For convenience in discussing the apparatus of the present invention, the bottom horizontal flange, which is substantially parallel to the top or upper flange 6, is divided into two portions, an inside flange portion 8 and an outside flange portion 10. The terms "inside" and "outside" are simply used for convenience with reference to FIGS. 1, 3, and 4.

The purlin 12 is substantially identical to the purlin 2. It is also an I-beam type purlin which includes a vertically extending web 14 and a top flange 16. Again, for convenience, the bottom flange of the I-beam purlin 12 is divided into two portions, a bottom inside flange portion 18 and a bottom outside flange portion 20.

The inside flange portions 8 and 18 of the purlins 2 and 12, respectively, extend toward each other. Several cross braces 30 are disposed between the inside flanges 8 and 18 of the purlins 2 and 12 to support the insulation 24. In FIG. 1, the cross braces 30 are shown spaced apart from each other and generally parallel to each other. The cross braces 30 provide horizontal support for the insulation batt or blanket 24 which is disposed between the purlins 2 and 12.

The cross brace 30, as shown in FIGS. 1, 2, 3, and 4, is made from a flat strap 32. The flat strap 32 is shown in FIG. 2(A).

The flat strap 32 is bent about in the center of the strap with a longitudinally extending bend 36 to divide the strap 32 into two arms 34 and 38. The arms 34 and 38 are substantially perpendicular to each other. This is shown in FIG. 2(B).

After forming the inverted "Vee" shaped element consisting of the two arms 34 and 38, the outer portions of the arms 34 and 38 are bent outwardly from the arms to provide a pair of aligned flanges 40 and 42. The finished cross brace 30 thus includes a pair of arms 34 and 38 with a pair of flanges 38 and 40 extending outwardly and generally aligned with each other from the arms 34 and 38, respectively. This is shown in FIG. 2(C).

After the strap or ribbon 32 is formed with the two arms 34 and 38, as shown in FIG. 2(B), the outer portions of the arms 34 and 38 are bent outwardly to comprise a pair of outwardly extending flanges 40 and 42, respectively. The flanges 40 and 42 are in a general parallel alignment with each other. As best shown in FIG. 2(C), the cross brace 30 generally resembles an inverted gull-shaped "V".

As shown in FIGS. 1, 3, and 4, the outwardly extending horizontal flanges 40 and 42 are disposed on the inside webs 8 and 18 of the purlins 2 and 12, respectively.

The arms 34 and 38 extend outwardly from the bend or apex 36. The apex 36 is the longitudinal bend line between the arms 34 and 38. The insulation batt 24 is disposed on the apexes 36 of the cross braces 30.

FIG. 5 is a perspective view of an alternate embodiment of the cross brace 30. The alternate embodiment, comprising a cross brace 50, includes generally the same cross-sectional configuration as the cross brace 30, but inverted and with hooks on the outer ends to secure the cross brace to the purlins. The cross brace 50 is disposed beneath the bottom flanges of the I-beam type purlins 2 and 12. The cross brace 50 includes outer hook portions which are secured to the outwardly extending or outside bottom flanges 10 and 20 of the purlins 2 and 12, respectively.

FIGS. 6(A), 6(B), 6(C), and 6(D) show successively the fabrication steps in forming the cross brace 50 from the beginning element, which is a cross brace 30.

FIG. 7 illustrates the cross brace 50 in its use environment. FIG. 7 is a view in partial section taken generally along line 7—7 of FIG. 5.

FIG. 8 is a view in partial section taken generally along line 8—8 of FIG. 5, showing the outer ends of the cross brace 50 as it is secured to the outside flange 20 of the purlin 12.

For the following discussion of the cross brace 50, attention will be directed to FIGS. 5, 6, 7, and 8.

The cross brace 50 is shown in FIG. 6(A) in its original configuration, and in the original configuration it comprises an inverted cross brace 30. The cross-sectional configuration is generally a gull winged "V" or a "Vee" with flanges extending outwardly from the ends of the arms. For the cross brace 50, as best shown in FIG. 7, the cross sectional configuration includes a pair of arms 54 and 58 extending substantially ninety degrees apart from an apex or bend 56. On the outer end of the arm 54, remote from the apex 56, is an outwardly extending flange 60. On the outer end of the arm 58, remote from the apex 56, is an outwardly extending flange 62. The flanges 60 and 62 are aligned with each other, and in the use environment, as shown in FIGS. 5 and 7, the batt 24 is disposed on the flanges 60 and 62.

With the cross brace 50 shown in its use orientation in FIG. 6(A), a force is applied by an anvil 80 and a clamp leaf 82 of a sheet metal brake to the outer end of the cross brace 50 to flatten the outer end of the cross brace 50 to virtually its original, ribbon configuration. The outer end of the cross brace 50, between the sheet metal brake elements 80 and 82 is identified by reference numeral 52 in FIGS. 6B, 6C, and 6D. The ribbon portion 52 of the cross brace 50 comprises an outer end portion of the cross brace 50 which is disposed beneath the bottom flanges 18 and 20 of the purlin 12. The opposite end of the cross brace 50 is substantially identical to the ribbon portion or outer end 52.

After the outer end 52 has been flattened, as shown in FIG. 6(B), a portion is bent upwardly, substantially ninety degrees, to provide an upwardly extending arm 64. This is shown in FIG. 6(C). The upper end of the arm 64 is then bent in the reverse direction to comprise a tip portion 66. This is shown in FIG. 6(D).

In FIG. 5, the opposite end of the cross brace 50 from the ribbon 52 is shown flattened to comprise a ribbon portion 72 with an upwardly extending arm portion and an inwardly extending tip portion 76 so as to be secured to the outwardly extending flange 10 of the purlin 2.

In its use environment, it may be seen from FIGS. 5 and 7 that the batt 24 is disposed on the outwardly extending flanges 60 and 62 of the cross brace 50. Accordingly, the batt 24 is supported by a greater area of the cross brace 50 than is the batt 24 of FIGS. 1–4. In FIGS. 1–4, the batt 24 is supported on the bend or apex 36 of each cross brace 30. In the embodiment of the cross brace 50 of FIGS. 5–8, the batt 24 is supported by the greater area of the outwardly extending arms 60 and 62.

The ease of installing the cross brace 30 may be readily understood since they are simply disposed on the inwardly extending flanges 8 and 18 of the purlins 2 and 12, respectively. On the other hand, the installation of the cross braces 50 is complicated by the necessity of securing the outer tips 66 and 72, respectively, to the outwardly extending flanges 20 and 10, respectively, of the purlins 12 and 2.

In fabrication, it is relatively simple to flatten the outer ends of the cross brace 50 into the ribbon portions 52 and 72. From there, the vertical and then the inwardly bending of the ribbon ends, which define the upwardly extending arms and the inwardly extending tips is slightly more difficult since it must generally be done in place to provide a relatively secure fit. Some pre-bending may be accomplished, particularly a pre-bending of the vertically extending arm portions of the outer ends. However, the inwardly bending of the tips must be accomplished on the job.

The use of the cross braces 30 and 50 is generally limited to the I-beam or H-beam type purlins, and in those situations where the purlins are spaced relatively close together. The structural integrity of the cross braces 30 and 50 is enhanced by the "Vee" configuration of the arms 30, 38, and 54, 58, respectively, with the outwardly extending arms. However, there may be situations when the I-beam or H-beam type purlins are spaced apart a distance which makes it desirable to provide a grid between adjacent purlins rather than merely the cross braces. In such a case, a grid may be fabricated out of the cross brace elements. Such a grid is illustrated in FIGS. 9, 10, and 11.

FIG. 9 is a top view of a pair of parallel I-beam type purlins 2 and 12 which are disposed apart a substantially greater distance than are the purlins 2 and 12 in FIGS. 1 and 5. A grid 100 is illustrated in FIG. 9 disposed between the inwardly extending flanges 8 and 18 of the purlins 2 and 12, respectively. The grid 100 comprises a plurality of spaced apart cross braces 110 appropriately secured together by a plurality of stringers 130. The stringers 130 are aligned generally parallel to each other and to the purlins 2 and 12, and the stringers 130 are generally perpendicular to the cross braces 110. The cross-sectional configuration of both the cross braces 110 and the stringers 130 are generally the same as the cross-sectional configuration of the cross braces 30 and 50. However, the flanges of the cross braces are disposed against each other in the grid.

Each cross brace 110 includes an arm 112 and an arm 116 extending outwardly generally perpendicular to each other from an apex or bend 114. Extending outwardly from the arm 112 is a flange 118, and extending outwardly from the arm 116 is a flange 120. The flanges 118 and 120 are generally aligned with each other. The stringers 130 are substantially identical to each other and to the cross braces 110 in configuration. Each stringer 130 includes an arm 132 and an arm 136 extending outwardly generally perpendicular to each other from an apex or bend 134. Extending outwardly from the arm 132 is a flange 138, and extending outwardly from the arm 136 is a flange 140. The flanges 138 and 140 are generally aligned with each other.

Figure 10:
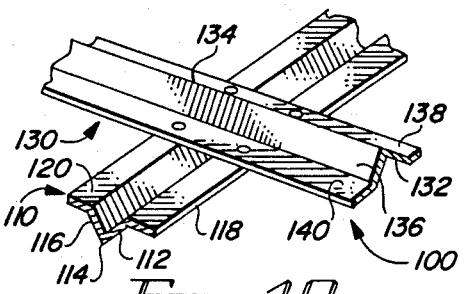
FIG. 10 is a perspective view illustrating a portion of the apparatus of FIG. 9.
Figure 11:
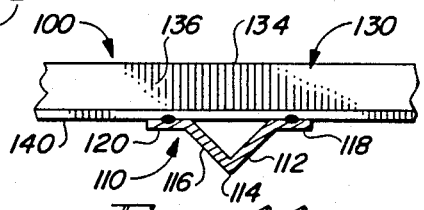
FIG. 11 is a view in partial section taken along line 11—11 of FIG. 9.

As shown in FIGS. 10 and 11 in substantial detail, the flanges 118, 120 and the flanges 138, 140 are in a facing, juxtaposed relationship. The flanges 118, 120 and 130, 140 are appropriately secured together, as by stapling or spot welding, to secure the cross pieces and the stringers together to comprise the grid 100.

With the grid 100 disposed between the purlins 2 and 12, insulation batts, such as the batts 24 shown in FIGS. 1, 3, 4, 5, and 7, will be appropriately supported on the grid 100 between the purlins 2 and 12.

Figure 13:
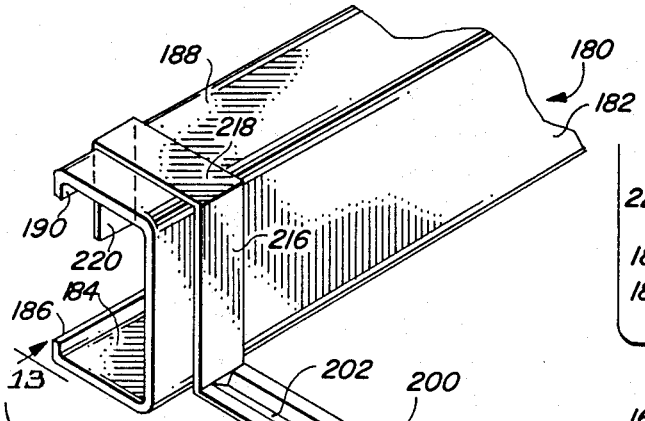
FIG. 13 is a view taken generally along line 13—13 of FIG. 12.
Figure 13:
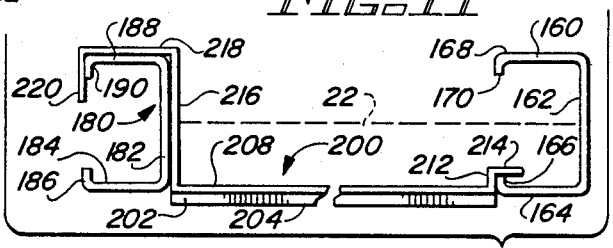
Figure 12:
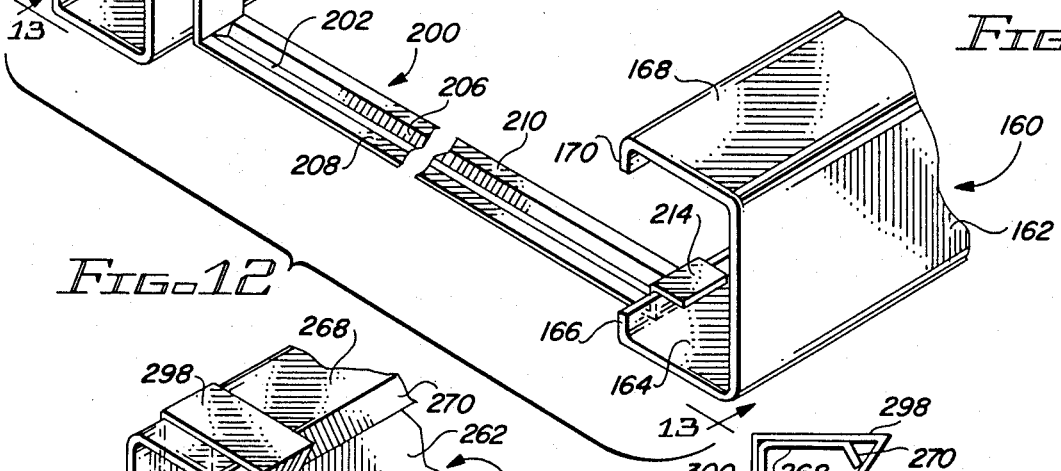
FIG. 12 is a perspective view illustrating an alternate embodiment of the apparatus of the present invention.

FIG. 12 is a perspective view of a portion of the two C-type purlins, including a C-type purlin 160 and a C-type purlin 180. The C-type purlins 160 and 180 are spaced apart from each other, and a cross brace 200 is shown extending between, and appropriately secured to, the purlins. FIG. 13 is an end view of the purlins 160 and 180 showing the cross brace 200 disposed between them. FIG. 13 also shows an insulation batt 24 in phantom disposed on the cross brace 200 and extending between the purlins. For the following discussion, reference will be made to FIGS. 12 and 13.

The C-type purlins 160 and 180 are substantially identical, and are aligned with each other generally parallel to each other, and they are "facing" in the same direction. The purlin 160 includes a vertically extending web 162 with a lower horizontal flange 164 extending outwardly from the bottom of the web 162. From the outer extremity of the lower horizontal flange 164 is a generally upwardly extending vertical lip 166. From the upper part of the web 162 is an outwardly extending horizontal flange 168. From the outer extremity of the upper horizontal flange 168 is a downwardly extending upper vertical lip 170. The lips 166 and 170 are generally aligned with each other.

The C-type purlin 180 is substantially identical to the purlin 160. The purlin 180 includes a vertically extending web 182. From the bottom of the web 182 there is a lower horizontally extending flange 184. From the outer extremity or outer edge of the lower horizontal flange 184 there is a vertically upwardly extending lip 186. From the upper portion of the vertical web 182 there is an upper outwardly extending horizontal flange 188. From the outer edge of the horizontal flange 188, remote from the web 182, there is a downwardly extending vertical lip 190. The upwardly extending vertical lip 186 and the downwardly extending vertical lip 190 are generally aligned with each other. It will be noted that the horizontally extending flanges are faced in the same direction, and thus the flanges 164 and 168 of the purlin 160 extend toward the web 182. The flanges 184 and 188 of the purlin 180 are "remote" from the flanges 164 and 168 of the purlin 160. The cross brace 200 is designed to be appropriately disposed on the lip 166 of the purlin 160 and to extend to the web 182 and be disposed on the flange 188 and lip 190 of the purlin 180.

The cross brace 200, between its outer ends, includes a center portion which is generally of the V-shaped configuration of the other cross brace elements discussed herein, including the cross brace and stringers of the grid 100. The cross brace 200 differs from the other cross braces in the configuration of its outer ends. The configuration of the outer ends of the cross brace 200 conforms to the physical characteristics of the C-type purlins 160 and 180.

The center portion of the cross brace 200 includes an arm 202 and an arm 206 extending outwardly generally ninety degrees from each other. The juncture of the arm 202 and 206 comprises an apex or fold line 204. A horizontally extending flange 208 extends outwardly from the arm 202, and a horizontally extending flange 210 extends outwardly from the arm 206. The flanges 208 and 210 are generally aligned with each other. The center portion of the cross brace 200 extends between the purlins. At the outer ends of the center portion of the brace 200 are the hook elements which actually secure the cross brace 200 to the purlins 160 and 180. At one end of the cross brace 200 is a relatively short upwardly extending arm portion 212. At the upper end of the arm extension 212 is a horizontally extending and outwardly directed arm extension 214. The upwardly extending portion 212 is disposed generally against the upwardly extending lip 166 of the purlin 160. The horizontally extending portion 214 is disposed on top of the lip 166 and extends inwardly, generally parallel to and above the flange 164.

At the opposite end of the cross brace 200 from the relatively short vertical arm extension 212 and the horizontal arm extension 214 is a relatively long upwardly extending arm portion 216. The height of the vertically extending arm portion 216 corresponds to the height of the web 182 of the purlin 180. Extending horizontally outwardly from the upper end of the vertical arm portion 216 is an outwardly extending horizontal arm portion 218. The overall length of the horizontal arm portion 218 corresponds to the overall length (or width) of the upper horizontal flange 188 of the purlin 180. Extending downwardly from the outer end of the horizontal portion 218 is a downwardly extending tip portion 220. The horizontal portion 220 comprises a hook extension which is disposed against the downwardly extending lip 190 of the purlin 180. The downwardly extending hook portion 220 may exceed the overall length of the lip 190, if desired. This is as shown in FIGS. 12 and 13.

In fabrication, the cross brace 200 is configured generally as described above, and is generally fabricated from a ribbon of steel. This is best described above in conjunction with the discussion of FIG. 2. The outer ends are then appropriately flattened as discussed above in conjunction with FIG. 6(B). The overall lengths of the flattened portions at the opposite ends of each cross brace are substantially different. The configurations of the opposite ends are also different. However, the same fabrication techniques generally apply to both ends. First, the ends of the cross braces 200 are flattened from their Vee configuration. Then, the ends are bent appropriately to form first the upwardly extending arm portions and second the outwardly extending portions. Last, the downward hook bend is made to provide the arm 220. The bends, as best shown in FIG. 13, are all right angle bends.

Figure 15:
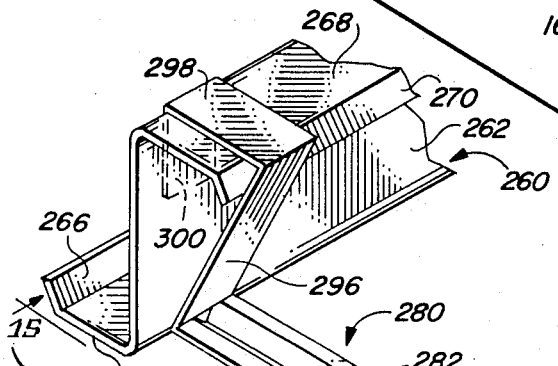
FIG. 15 is a view taken generally along line 15—15 of FIG. 14.
Figure 15:
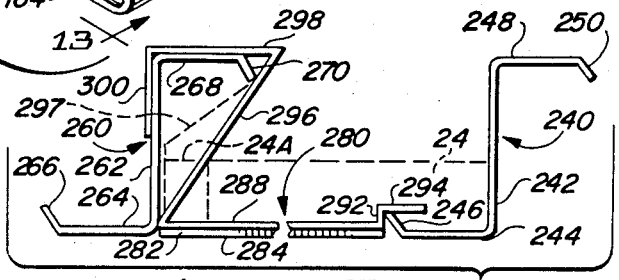
Figure 14:
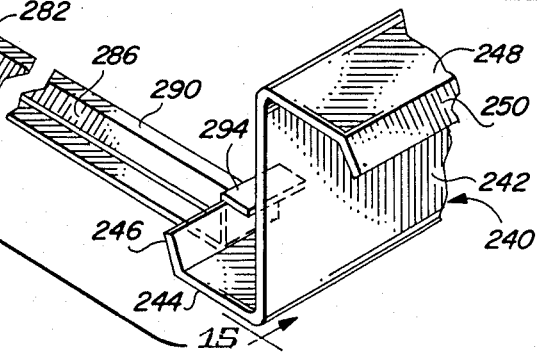
FIG. 14 is a perspective view illustrating another alternate embodiment of the apparatus of the present invention.

FIG. 14 is a perspective view of a pair of Z-type purlins 240 and 260, spaced apart from each other and aligned generally parallel to each other. A cross brace 280 is shown extending between and secured to the purlins. FIG. 15 is a side view of the Z-type purlins 240 and 260 showing the cross brace 280 disposed between the purlins. An insulation batt 24 is shown disposed on the cross brace 280 between the purlins 240 and 260.

The Z-type purlin 240 includes a generally vertically extending web 242 with a pair of horizontally extending flanges secured to the bottom and top of the vertical web. At the bottom of the vertical web 242 is a horizontally extending flange 244. Extending upwardly from the outer edge of the bottom flange 244 is an upwardly and outwardly extending lip 246. The term "outwardly" indicates that the direction of the lip 246 is generally away from the vertical web 242 and horizontal flange 244.

Extending outwardly from the top or upper portion of the vertical web 242 is a horizontally extending flange 248. The horizontally extending flange 248 extends in the opposite direction from the bottom horizontal flange 244. Extending downwardly and outwardly from the outer edge of the upper flange 248, remote from the web 242, is a lip 250. The lip 250 extends downwardly and outwardly, away from the vertical web 240.

The Z-type purlin 260 is substantially identical to the purlin 240. The purlin 260 includes a vertically extending web 262 with a pair of horizontally extending flanges 264 and 268. The flange 264, the lower flange, extends horizontally outwardly from the bottom end of the web 262. At the outer edge of the flange 264, remote from the web 262, is a generally upwardly and outwardly extending lip 266. Again, the term "outwardly" refers to the fact that the lip 266 extends generally away from the flange 264 and away from the web 262.

At the top of the vertical web 262 is the upper horizontally extending flange 268. At the outer edge of the flange 268 is a generally downwardly and outwardly extending lip 270. The lip 270 extends outwardly with respect to the flange 268 and the web 262. The horizontal flanges 264 and 268 are generally parallel to each other, but extend away from the central web 262 in opposite directions.

The cross brace 280 includes a central portion which includes the same general V-shaped cross-sectional configuration, with the outwardly extending flanges, as the central portion of the other cross braces discussed herein, including the cross braces 110 and the stringers 130 of the grid 100. Thus, the cross-sectional configuration of the central portion of the cross brace 280 includes a a pair of arms 282 and 286 extending substantially perpendicularly away from each other from an apex or bend 284. At the outer end of the arms 282 and 286 are a pair of outwardly extending flanges 288 and 290, respectively. The flanges 288 and 290 are generally aligned with each other and extend generally horizontally when the cross brace 280 is in its use position, as shown in FIGS. 14 and 15.

The ends of the cross brace 280 are appropriately configured to allow the cross brace 280 to be secured between the purlins 240 and 260. The cross brace 280 includes, at one end, adjacent to the purlin 240, a relatively short upwardly extending arm or vertical flange 292. Extending outwardly from the upper end of the flange 292, and extending generally parallel to the central portion of the cross brace 280, is a horizontally extending flange or arm 294. As shown in FIGS. 14 and 15, the juncture of the flanges 292 and 294 is disposed on the outer end of the lower lip 246. The horizontally extending flange 294 extends over the lip 246 and over a portion of the bottom flange 244 of the purlin 240. The configuration of the end of the cross brace 280 is substantially identical to the corresponding end of the cross brace 200, discussed above.

At the opposite end of the cross brace 280, remote from the relatively short vertical flange 292 and the horizontal flange 294, is an angled flange 296. The angled flange 296 extends, from adjacent to the vertical web 282, upwardly and inwardly over a portion of the central part of the cross brace 280 until the flange 296 reaches the height of the upper horizontally extending flange 268 of the purlin 260. From that location, the cross brace 280 includes a horizontally extending flange 298, which is disposed on top of the horizontal flange 268 of the purlin 260. The overall length of the horizontal flange 298 is sufficient to allow the flange 298 to clear the flange 268 and the downwardly and outwardly extending lip 270 of the purlin 280. From the outer end of the flange 298 is a vertically downwardly extending flange 300. The downwardly extending flange 300 is disposed adjacent to, and generally against, the web 262 of the purlin 260.

The bottom of the cross brace 280, which is the aligned flanges 288 and 290, is disposed in the area of the bottom flanges 244 and 264 of the purlins 240 and 260, respectively.

The cross brace 280 is appropriately secured between the purlins 240 and 260 to allow an insulation batt 24, illustrated in phantom in FIG. 15, to be disposed on the corss brace 280 and extends over a portion of the flange 244 of the purlin 240.

The fabrication of the flanges 292, 294 and 296, 298, 300 of the cross brace 280 is substantially the same as discussed above in conjunction with the cross braces 50 and 200. That is, after the V-shaped configuration, with the outwardly extending flanges, is given to a ribbon of steel to form the central portion of the cross brace 280, the ends of the cross brace 280 are appropriately flattened, as discussed above and as generally shown in FIG. 6B. The flattened end portions are of a predetermined length which will allow for the vertical flange 292 and the horizontal flange 294 at one end of the cross brace 280, and for the angled flange 296, the horizontal flange 298, and the vertical flange 300 at the opposite end of the cross brace 280.

After the ends of the cross brace 280 are appropriately flattened, the appropriate bends are made in the flattened ends to provide the vertical flange 292 and the horizontal flange 294 at one end, and to provide the angled flange 296, horizontal flange 298, and vertical outer flange 300 at the other end. The appropriate bends are made to provide the configuration desired.

For installation purposes, the angled flange 296, horizontal flange 298, and downwardly extending vertical flange 300 are first placed over the purlin 260. Then the cross brace 280 is moved downwardly into place as shown in FIGS. 14 and 15, with the upwardly extending vertical flange 292 and the horizontally outwardly extending flange 294 disposed on the lip 246 of the purlin 240. With a plurality of cross braces 280 spaced apart along the purlins 240 and 260, insulation material, such as the batt 24, may be appropriately placed between the purlins 240 and 260 on the cross braces 280.

It will be noted in FIG. 15 that the angle of the flange 296 results in the termination of the insulation 24 several inches from the vertical web 262 of the purlin 260. If desired, the installers of the insulation may simply take time to cut out a notch in the insulation 24 at each cross brace to allow the insulation to extend the full width or distance between purlins. This is shown in FIG. 15 by reference numeral 24A. However, such notching would obviously take a substantial amount of time.

An alternative to the notching is illustrated in FIG. 15 in dotted line (phantom). A vertical and a diagonal portion 297 of the cross brace 280 extends upwardly along the web 262 of the purlin 260 and then outwardly. The vertical portion extends upwardly a distance slightly greater than the height of the insulation 24. The diagonal portion then extends outwardly to clear the lip 270 and joins the horizontal flange 298.

Using the modified or alternative design, which includes the vertical and diagonal portion 297 extending upwardly and then diagonally inwardly from the bottom portion of the cross brace 280, a full width insulation batt, including the portion 24 and the portion 24A, may be disposed between adjacent purlins. The relatively short height of the lip 246 of the purlin 240 and the vertical flange 292 and the horizontal flange 294 of the cross brace 280 essentially are ignored since they do not affect the overall width of the insulation batts.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Support structure for supporting insulation between purlins in metal buildings, comprising, in combination:

a plurality of cross brace extending between and disposed on flanges of the purlin, each cross brace including a first end means secured to one purlin, a second end means secured to another purlin, and a center portion between the first and second end portions having a first arm, a first flange secured to the first arm and extending outwardly therefrom, a second arm secured to the first arm, a second flange secured to the second arm and extending outwardly therefrom and generally aligned with the first flange, and a juncture between the first arm and the second arm defining, in a cross section of the cross brace, an apex from which the first and second arms extend; and stringer means, including at least a single stringer secured to the plurality of cross braces between the purlins and defining with the cross braces a grid between the purlins for supporting insulation, and including a third arm, a third flange secured to the third arm and extending outwardly therefrom, a fourth arm secured to the third arm, a fourth flange secured to the fourth arm and extending outwardly therefrom and generally aligned with the third flange, and the plurality of cross braces and the stringer are secured together at the flanges, 2. The apparatus of claim 1 in which the stringer means comprises a plurality of stringers secured to the plurality of cross braces at the flanges.

3. The apparatus of claim 1 in which the first end means comprises a continuation of the center portion, with the first and second flanges disposed on a portion of the one purlin.

4. The apparatus of claim 3 in which the second end means comprises a continuation of the center portion, with the first and second flanges disposed on a portion of the other purlin.

5. The apparatus of claim 1 in which the first end means includes a vertical arm portion disposed adjacent to the first purlin, and a tip portion extending from the vertical arm portion over the first purlin to secure the first end means to the first purlin.

6. The apparatus of claim 5 in which the first end means further includes a flat strap portion extending between the center portion and the vertical arm portion.

7. The apparatus of claim 1 in which the first end means includes a relatively short upwardly extending portion secured to the center portion, and a first generally horizontally extending portion secured to the relatively short upwardly extending portion remote from the center portion and disposed on a portion of the one purlin.

8. The apparatus of claim 7 in which the second end means includes a relatively long upwardly extending portion secured to the center portion, and a second generally horizontally extending portion secured to the relatively long upwardly extending portion remote from the center portion and disposed on a portion of the other purlin.

9. The apparatus of claim 8 in which the second end means further includes a downwardly extending flange portion secured to the second generally horizontally extending portion remote from the relatively long upwardly extending portion.

10. The apparatus of claim 7 in which the second end means includes an angled flanged secured to the center portion, and a generally horizontally extending flange secured to the angled flange remote from the center portion and disposed on a portion of the other purlin.

11. The apparatus of claim 10 in which the second end means further includes a downwardly extending flange secured to the generally horizontally extending flange remote from the angled flange.

12. The apparatus of claim 7 in which the second end means includes a vertically upwardly extending portion secured to the center portion and disposed adjacent to a first portion of the other purlin, a diagonally extending portion secured to the vertically upwardly extending portion, and a horizontally extending portion secured to the diagonally extending portion and disposed on a second portion of the other purlin.

13. The apparatus of claim 12 in which the second end means further includes a downwardly extending flange secured to the horizontally extending portion remote from the diagonally extending portion.

* * * * *